US010980366B1

(12) United States Patent
Wong et al.

(10) Patent No.: US 10,980,366 B1
(45) Date of Patent: Apr. 20, 2021

(54) EDGED TOOL STORAGE DEVICE SET

(71) Applicant: KAI R&D CENTER CO., LTD., Gifu (JP)

(72) Inventors: Hung Tai Wong, Gifu (JP); Cheuk Wa Pun, Gifu (JP)

(73) Assignee: KAI R&D CENTER CO., LTD., Seki (JP)

( * ) Notice: Subject to any disclaimer, the term of this patent is extended or adjusted under 35 U.S.C. 154(b) by 0 days.

(21) Appl. No.: 16/971,267

(22) PCT Filed: Jan. 29, 2020

(86) PCT No.: PCT/JP2020/003209

§ 371 (c)(1),
(2) Date: Aug. 19, 2020

(51) Int. Cl.
*A47G 21/14* (2006.01)

(52) U.S. Cl.
CPC ..... *A47G 21/14* (2013.01)

(58) Field of Classification Search
CPC ..... A47G 21/14; A47B 73/006; A47B 81/04; A47F 7/0028
See application file for complete search history.

(56) References Cited

U.S. PATENT DOCUMENTS 2,994,450 A * 8/1961 De Van ..... B65D 21/0204 217/29
3,194,426 A * 7/1965 Brown, Jr. ..... B65D 21/0204 220/23.4
4,258,847 A * 3/1981 Nierman ..... B65D 21/0202 206/504
4,262,467 A * 4/1981 Faisant ..... A01G 9/027 52/311.2
4,537,315 A * 8/1985 Griffin ..... A47G 21/14 206/553
4,770,297 A * 9/1988 Chang ..... B65D 85/28 206/379
4,970,006 A * 11/1990 Martinez ..... A47G 21/14 248/37.3
5,002,199 A * 3/1991 Frahm ..... B65D 21/0202 206/509
5,024,067 A * 6/1991 Maier, II ..... B65D 21/0204 220/23.4
5,271,515 A * 12/1993 Berkheimer ..... B65D 21/023 206/503
D464,887 S * 10/2002 Sherwell ..... D7/612
(Continued)

FOREIGN PATENT DOCUMENTS

DE 9303374 U1 * 5/1993 ..... A47B 87/0276
DE 29801206 U1 * 3/1998 ..... A47B 73/006
(Continued)

*Primary Examiner* — Stanton L Krycinski
(74) *Attorney, Agent, or Firm* — White & Case LLP

(57) ABSTRACT

The edged tool storage device set is an edged tool storage device set including a first edged tool storage device and a second edged tool storage device, in which the first edged tool storage device includes a first case that has a first hole storing a blade of an edged tool and a flange-shaped first projection that projects from the first case in a direction crossing the extending direction of the first hole, and the second edged tool storage device includes a second case that has a second hole storing a blade of an edged tool and a groove-shaped first recess that faces a direction crossing the extending direction of the second hole and has a shape allowing fitting with the first projection.

7 Claims, 7 Drawing Sheets

(56) References Cited

U.S. PATENT DOCUMENTS 6,502,711 B1 * 1/2003 McRae ..... B65D 21/0204 211/71.01
7,004,336 B2 * 2/2006 Dagan ..... A47B 73/006 211/181.1
7,210,588 B1 * 5/2007 Ayon ..... A47G 21/14 211/70.7
7,434,693 B2 * 10/2008 Mosko ..... A47G 21/14 206/553
7,448,506 B2 * 11/2008 Berti ..... A47G 21/14 206/553
D586,225 S * 2/2009 Devereaux ..... D9/541
8,191,718 B2 * 6/2012 Hovatter ..... B01L 9/06 211/85.18
8,348,077 B2 * 1/2013 Wimmer ..... B65D 21/0204 220/23.4
8,985,366 B2 * 3/2015 Barth ..... B65D 21/0204 220/23.4
9,346,585 B2 * 5/2016 Hendrickson ..... B65D 21/0231
10,390,661 B1 * 8/2019 Steingraber ..... F16B 1/00
D865,518 S * 11/2019 McConnell ..... D9/436
10,561,238 B1 * 2/2020 Gutierrez ..... A47B 73/006
2006/0261063 A1 * 11/2006 Dyehouse ..... B65D 21/0204 220/23.4
2008/0060204 A1 * 3/2008 Chen ..... A47G 21/14 30/298.4
2008/0060205 A1 * 3/2008 Schmidt ..... A47G 21/14 30/298.4
2009/0090647 A1 * 4/2009 Panchai ..... B65D 81/361 206/504
2013/0248470 A1 * 9/2013 Klein ..... A45C 11/34 211/65
2016/0367055 A1 * 12/2016 Rausch ..... A47G 21/14

FOREIGN PATENT DOCUMENTS

FR 2069201 A5 * 9/1971 ..... A47G 21/14
JP S61-100348 U 6/1986
JP 1993-088995 U 12/1993
JP 3087683 U 8/2002
JP S001312841 U 10/2007
JP 3199142 U 8/2015
JP 2019-077030 A 5/2019
JP 2019-077030 A 5/2019
JP 6569928 B1 9/2019

* cited by examiner

EDGED TOOL STORAGE DEVICE SET

CROSS-REFERENCE TO RELATED APPLICATION

This application is a national stage filing under 35 U.S.C. § 371 of International Application No. PCT/JP2020/003209, filed on Jan. 29, 2020. The specification of the foregoing application is incorporated herein by reference in its entirety.

TECHNICAL FIELD

One aspect of the present invention relates to a set of edged tool storage device and the like, storing edged tools.

BACKGROUND ART

Conventionally, a kitchen knife holder storing a kitchen knife often has a structure in which the kitchen knife is inserted in an erected state to be held. Moreover, some have a structure in which a kitchen knife is held in a state where the blade side of the kitchen knife is laid downward. Such a kitchen knife holder is disclosed in Patent Documents 1 to 5.

CITATION LIST

Patent Documents

Patent Document 1: Japanese Patent No. 6569928

Patent Document 2: Japanese Patent Application Laid-open No. 2019-77030

Patent Document 3: Japanese Registered Utility Model No. 3087683

Patent Document 4: Japanese Registered Utility Model No. 3199142

Patent Document 5: Japanese Examined Utility Model Application

Publication No. S61-100348

SUMMARY

Technical Problem

A kitchen knife holder is often placed in a kitchen of a home or a restaurant. The conventional kitchen knife holder simply has a function of storing one or a certain number of several kitchen knives, and there has not been provided a kitchen knife holder allowing various modes of use in accordance with a user preference and a use state by coupling or separating a plurality of kitchen knife holders. Moreover, few kitchen knife holders have focused on their outer appearance, with there being no real concept of kitchen knife holders as interior accessories placed in a kitchen. However, cooking tools including a kitchen knife placed in a kitchen are not only simple cooking tools but also interior accessories decorating the kitchen. Thus, such cooking tools with excellent appearances convert the kitchen into a joyful space. In addition, the functionality and sense of playfulness make the kitchen a more joyful space. The invention aims at providing a set of edged tool storage device allowing various modes of use in accordance with a user preference and a use state, and having a function along with an excellent appearance and sense of playfulness as an interior accessory, making the kitchen a more joyful space.

Solution to Problem

In order to solve the above-described problems, the invention provides an edged tool storage device and an edged tool storage device set having the following structure. In the following description, reference signs and the like in the drawings may be shown in parentheses for easy understanding of the invention. However, the components of the invention are not limited to these concrete structures, and should be interpreted widely within the range technically understood by a person skilled in the art.

One aspect of the invention is an edged tool storage device set (5) including a first edged tool storage device (1) and a second edged tool storage device (2), in which the first edged tool storage device includes a first case (11) that has a first hole (11*a*) storing a blade of an edged tool (3) and a flange-shaped first projection (14*b*) that projects from the first case in a direction crossing an extending direction of the first hole, and the second edged tool storage device includes a second case (11) that has a second hole (11*a*) storing a blade of an edged tool (4) and a groove-shaped first recess (25*a*) that faces a direction crossing an extending direction of the second hole and has a shape allowing fitting with the first projection.

In the edged tool storage device set storing a kitchen knife, kitchen scissors, and the like with the above-described structure, it is possible to mechanically couple or separate the first edged tool storage device and the second edged tool storage device, which enables adjustment of the number of storable edged tools by combining a plurality of edged tool storage device in accordance with a user preference and a use state. Furthermore, it is possible to build an edged tool storage device set storing a plurality of pieces of edged tools with a feeling of playfulness such as when combining toy blocks. Moreover, it is possible to arrange the first edged tool storage device and the second edged tool storage device by coupling them to each other. This may give a collectively organized impression of the first edged tool storage device and the second edged tool storage device to a user, as compared with the case in which a plurality of edged tool storage device are arranged independently. Consequently, it is possible to provide an edged tool storage device set which is excellent in appearance. Therefore, it is possible to combine an edged tool storage device in accordance with a user preference and a use state, and transform the edged tool storage device from a kitchen knife holder simply having a function of storing a kitchen knife into an interior accessory with a sense of playfulness, capable of storing edged tools. Moreover, with fitting between flanges and grooves, it is possible to freely change a coupling angle between the first edged tool storage device and the second edged tool storage device. In this manner, it is possible to adjust the above-described coupling angle to an angle in accordance with a user preference, for example, which improves the appearance of the edged tool storage device set.

In the above-described edged tool storage device set, it is preferable that the first projection projects over from one direction to the other direction outside of the first case.

In the edged tool storage device set with the above-described structure, with the structure in which the projecting direction of the first projection is expanded from one direction to the other direction, it is possible to expand a variable range of the coupling angle between the first edged tool storage device and the second edged tool storage device.

In the above-described edged tool storage device set, it is preferable that the first recess is formed over from one direction to the other direction outside of the second case.

In the edged tool storage device set with the above-described structure, with the structure in which the formation direction of the first recess is expanded from one direction to the other direction, it is possible to expand a variable range of the coupling angle between the first edged tool storage device and the second edged tool storage device.

In the above-described edged tool storage device set, it is preferable that the first projection includes, in a planar view from the extending direction of the first hole, a first side (16*a*), a second side (16*b*) facing the first side with the first hole interposed therebetween, and a third side (16*c*) positioned between the first side and the second side, and a distance between the first side and the second side becomes larger toward the third side.

In the edged tool storage device set with the above-described structure, when the first edged tool storage device is placed sideways on a table or the like, the long third side is brought into contact with the table. Thus, it is possible to stably place the first edged tool storage device sideways on the table without coupling with the second edged tool storage device. Moreover, even in a state where the first edged tool storage device is coupled to the second edged tool storage device, it is possible to bring the long third side into contact with the table and stably place the edged tool storage device set sideways on the table.

In the above-described edged tool storage device set, it is preferable that the first projection projects substantially horizontally and the first recess is formed substantially horizontally.

In the edged tool storage device set with the above-described structure, with fitting between the horizontally projected flanges and the horizontally formed grooves, it is possible to freely change a coupling angle between the first edged tool storage device and the second edged tool storage device while they are arranged in a self-standing state on the substantially horizontal table, for example. This enables, for example, the first edged tool storage device and the second edged tool storage device to be stably placed on the table with a coupling angle which is excellent in appearance.

In the above-described edged tool storage device set, it is preferable that the second edged tool storage device further includes a flanged-shaped second projection (24*a*) that projects from the second case in a direction crossing the extending direction of the second hole, and a flanged-shaped third projection (24*b*) that projects substantially parallel to the second projection in a substantially same direction as the projecting direction of the second projection, and the first recess is formed between the second projection and the third projection.

In the edged tool storage device set with the above-described structure, not only the first recess but also at least one of the second projection and the third projection may be used for fitting with the recess of the first edged tool storage device, which strengthens coupling with the first edged tool storage device. Moreover, the two flanges arranged substantially parallel form a pleated appearance, which improves the appearance of the edged tool storage device set.

In the above-described edged tool storage device set, it is preferable that the first edged tool storage device further includes a flange-shaped fourth projection (14*a*) that projects substantially parallel to the first projection in a substantially same direction as the projecting direction of the first projection and a groove-shaped second recess (15*a*) that is formed between the first projection and the fourth projection.

In the edged tool storage device set with the above-described structure, not only the first projection but also the second recess may be used for fitting with the projection of the second edged tool storage device, which strengthens coupling with the second edged tool storage device. Moreover, the two flanges arranged substantially parallel form a pleated appearance, which improves the appearance of the edged tool storage device set.

In the above-described edged tool storage device set, it is preferable that a distance between one end of the first case and the first projection is substantially same as a distance from one end of the second case and the first recess.

In the edged tool storage device set with the above-described structure, in a case where the first edged tool storage device is coupled to the second edged tool storage device, it is possible to match one end of the first case and one end of the second case, which allows the first edged tool storage device and the second edged tool storage device to be stably arranged in a self-standing state or to be laid close to a wall in a compact manner. Moreover, the matching state of the ends may give a collectively organized impression to a user, which improves the appearance of the edged tool storage device set.

DESCRIPTION OF EMBODIMENTS

Figure 1:
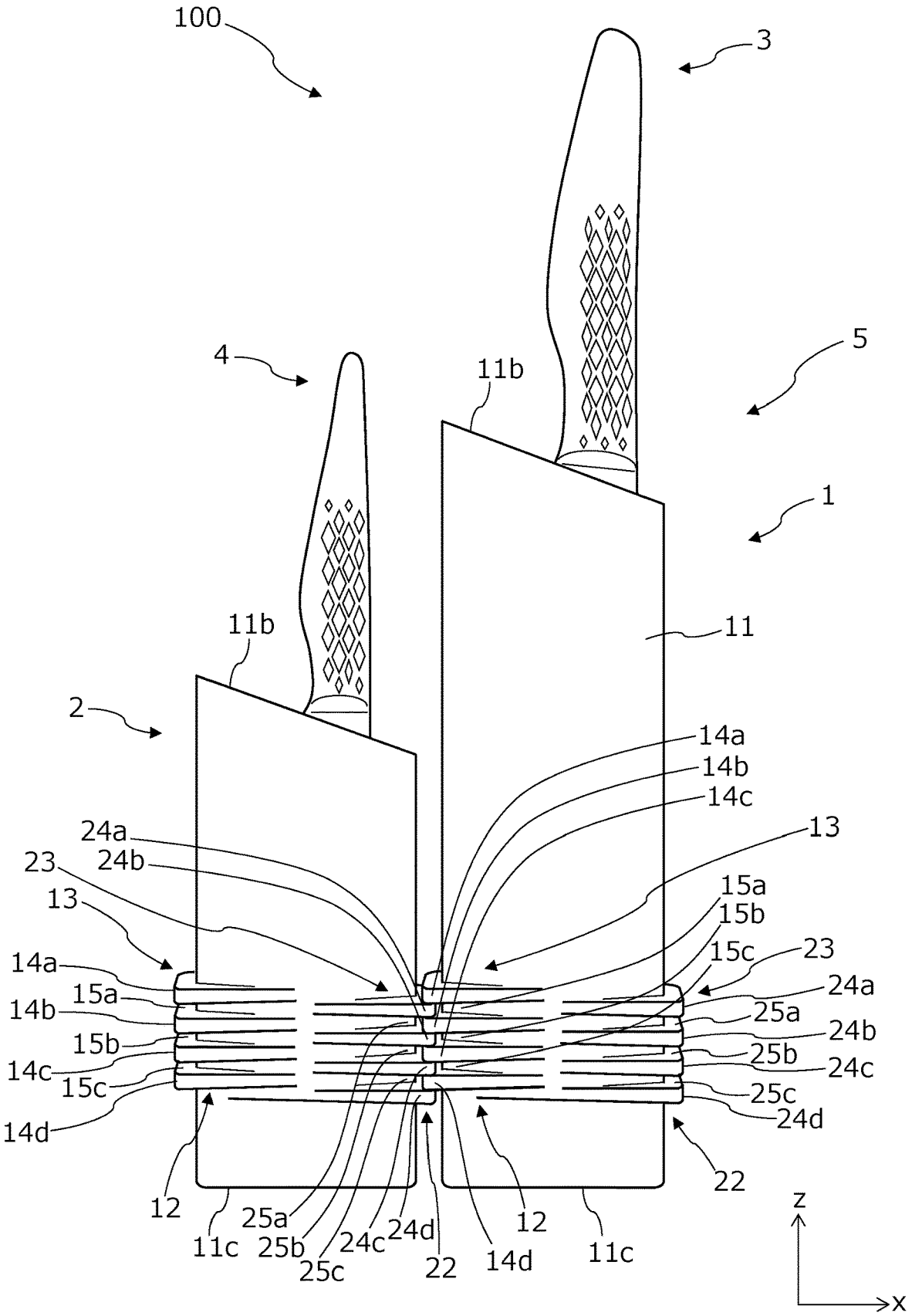
FIG. 1 is a diagram illustrating a structure of a kitchen utensil according to the embodiment.

The first edged tool storage device according to one aspect of the invention is characterized by a structure that includes a case with a hole for storing a blade of an edged tool, and a first projection projecting from the case in a direction crossing an extending direction of the hole, and allows removable fitting with a recess of a second edged tool storage device.

The edged tool storage device of the invention will be specifically described with reference to the drawings. However, the embodiment and example described in the following are only examples of the invention, and the technical range of the invention is not to be interpreted restrictively. Note that in the drawings, the same components are represented with the same reference signs, and the description thereof may be omitted.

1. Embodiment

<(1) Structure of Kitchen Utensil 100>

FIG. 1 is a diagram illustrating a structure of a kitchen utensil according to the embodiment. Each drawing illustrates an x-axis, a y-axis, and a z-axis. The axis in a direction opposite from the direction of gravity is defined as the "z-axis". The axis perpendicular to the z-axis is defined as the "y-axis". Moreover, the axis perpendicular to both the y-axis and the z-axis is defined as the "x-axis". Here, the x-axis, the y-axis, and the z-axis form right-handed threedimensional orthogonal coordinates. In the following, the arrow direction of the z-axis may be referred to as a z-axis (+)-side, and the opposite direction of the arrow may be referred to as a z-axis (−)-side. The same applies to the other axes. Note that the z-axis (+)-side and the z-axis (−)-side may be referred to as the "upper side" and the "lower side", respectively.

As illustrated in FIG. 1, a kitchen utensil 100 of the embodiment includes an edged tool storage device set 5, a first kitchen knife 3, and a second kitchen knife 4. The edged tool storage device set 5 includes a first edged tool storage device 1 and a second edged tool storage device 2. In the following, each the first kitchen knife 3 and the second kitchen knife 4 may be referred simply as kitchen knives. The kitchen knife is, for example, a Santoku knife, a Deba knife, a Yanagiba knife, an Usuba knife, a Chef's knife, or a paring knife. The knife includes a handle and a blade. In the embodiment, the size of the second kitchen knife 4 is smaller than the size of the first kitchen knife 3. The kitchen knife is one concrete example of the "edged tool" in the invention.

The edged tool storage device set 5 of the embodiment is formed to be placed in a self-standing state by coupling the first edged tool storage device 1 and the second edged tool storage device 2. The first edged tool storage device 1 stores the blade of the first kitchen knife 3 and holds the first kitchen knife 3. The second edged tool storage device 2 stores the blade of the second kitchen knife 4 and holds the second kitchen knife 4.

<(2) Structure of First Edged Tool Storage Device 1>

Although the second edged tool storage device 2 has a different size from the first edged tool storage device 1, it is an edged tool storage device with the same structure. Thus, the first edged tool storage device 1 will be described representatively here and the description of the second edged tool storage device 2 will be omitted.

Figure 2:
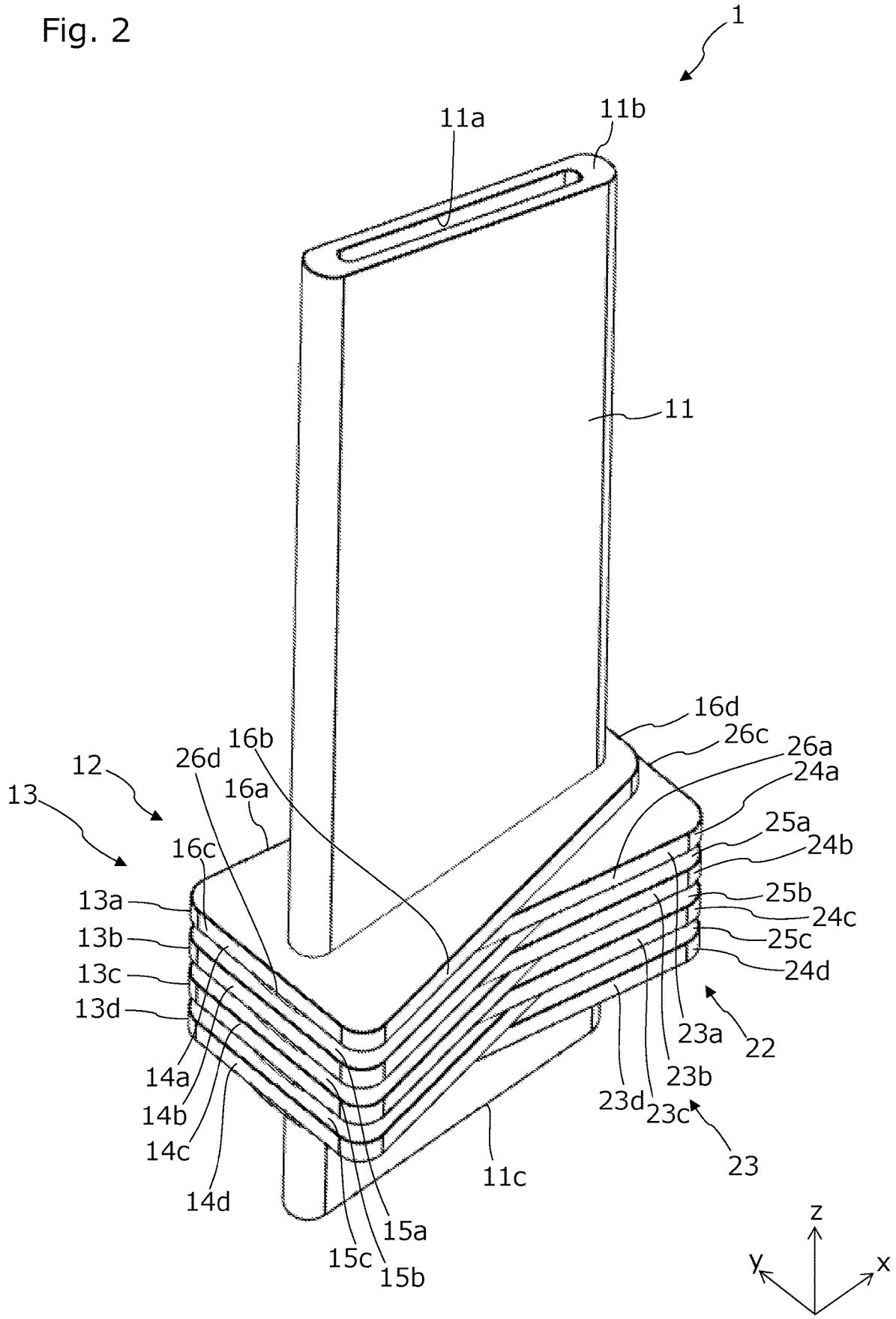
FIG. 2 is a perspective view of a first edged tool storage device according to the embodiment.
Figure 3:
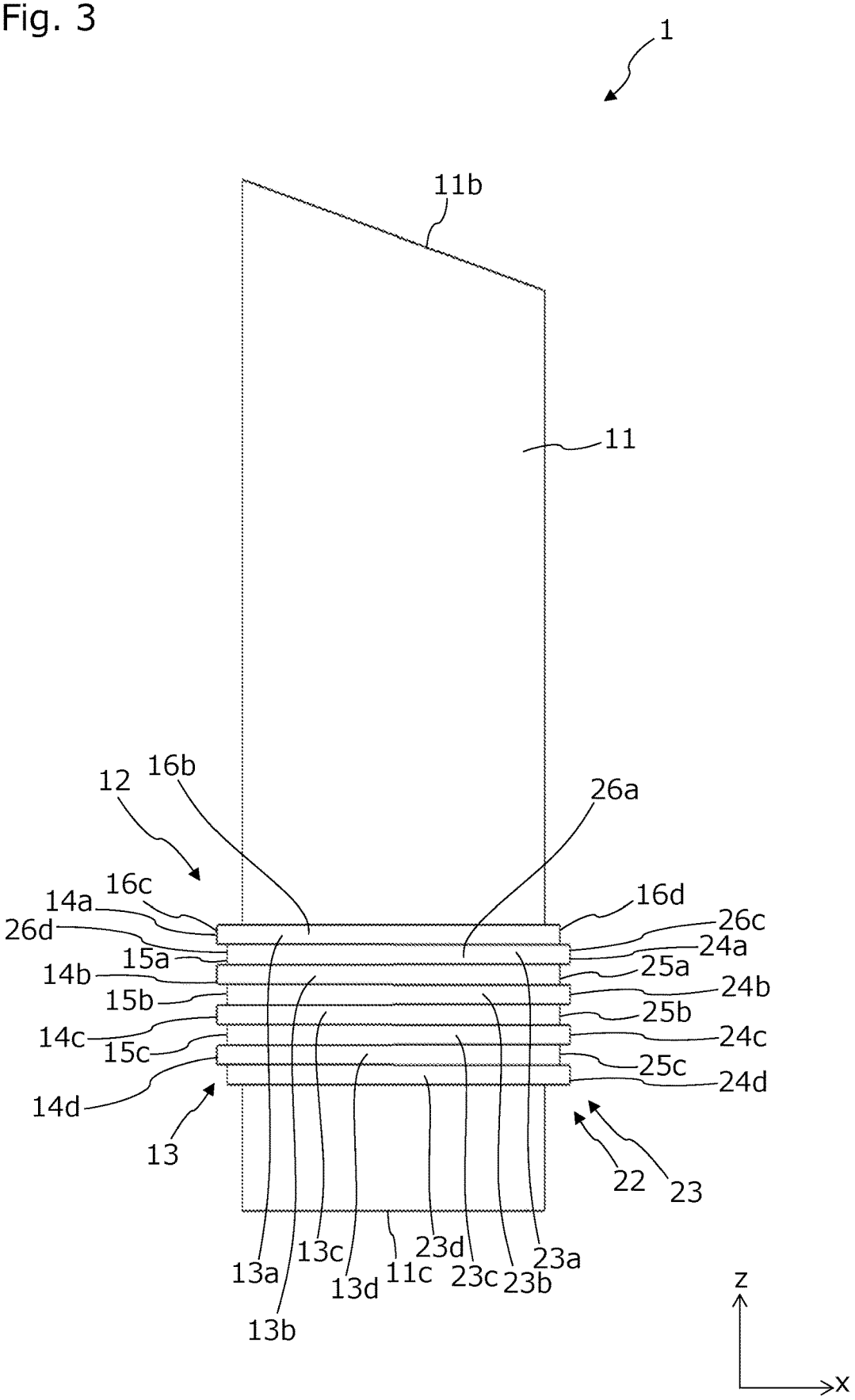
FIG. 3 is a plan view of the first edged tool storage device of the embodiment, viewed from a y-axis (−)-side.
Figure 4:
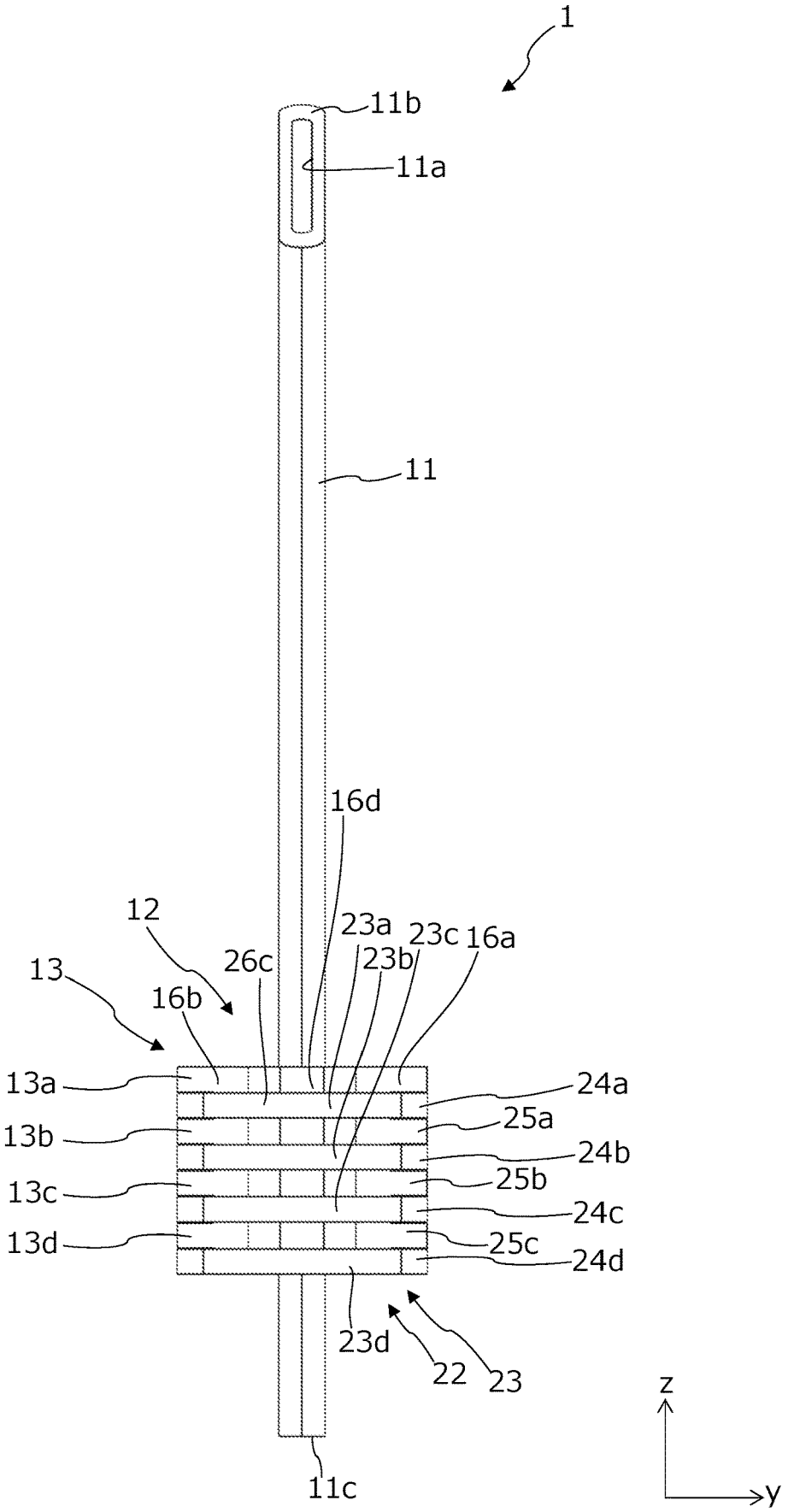
FIG. 4 is a plan view of the first edged tool storage device of the embodiment, viewed from an x-axis (+)-side.
Figure 5:
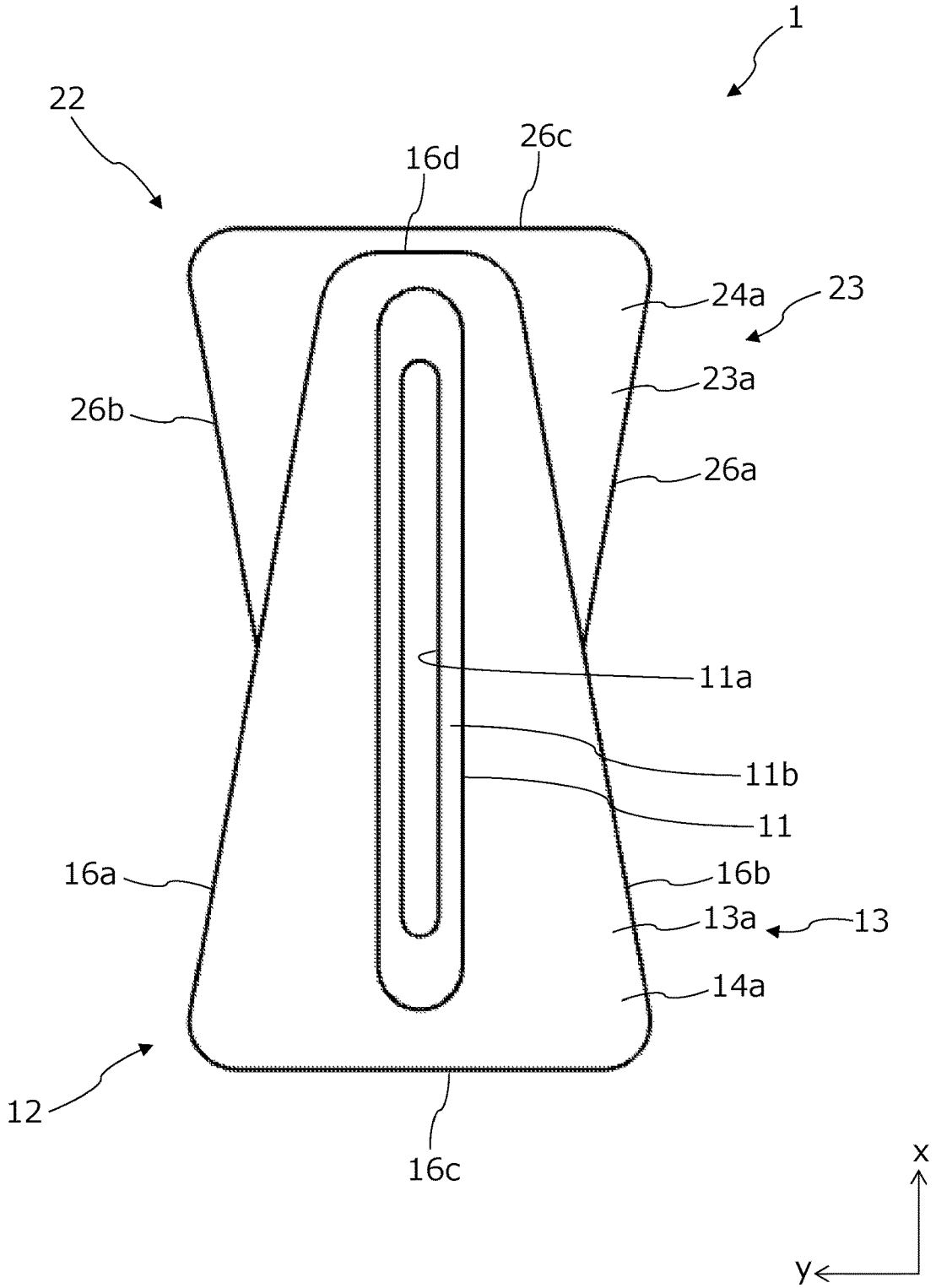
FIG. 5 is a plan view of the first edged tool storage device of the embodiment, viewed from a z-axis (+)-side.

FIG. 2 is a perspective view of the first edged tool storage device according to the embodiment. FIG. 3 is a plan view of the first edged tool storage device of the embodiment, viewed from a y-axis (−)-side. FIG. 4 is a plan view of the first edged tool storage device of the embodiment, viewed from an x-axis (+)-side. FIG. 5 is a plan view of the first edged tool storage device of the embodiment, viewed from a z-axis (+)-side. As illustrated in FIG. 1 to FIG. 5, the first edged tool storage device 1 of the embodiment includes a cylindrical member 11, a first flange group 12, and a second flange group 22.

<Cylindrical Member 11>

The cylindrical member 11 is a member extending substantially parallel to the z-axis direction, and is made of a wooden material, for example. Note that the cylindrical member 11 may be made of another kind of materials such as resin or metal. In the embodiment, the section of the cylindrical member 11 has a substantially rectangular shape with a long axis corresponding to the x-axis direction and rounded corners. A bottom surface 11*c* substantially parallel to the xy surface is formed at the lower end of the cylindrical member 11. An upper surface 11*b* inclined relative to the xy plane surface is formed at the upper end of the cylindrical member 11. In the embodiment, the upper surface 11*b* faces diagonally upward to the x-axis (+)-side. Note that the upper surface 11*b* may be a surface substantially parallel to the xy surface. The cylindrical member 11 of the first edged tool storage device 1 is one concrete example of the "first case" in the invention. The cylindrical member 11 of the second edged tool storage device 2 is one concrete example of the "second case" in the invention.

The cylindrical member 11 includes a long hole 11*a* with a long axis corresponding to the x-axis direction, which stores a blade of a kitchen knife. The long hole 11*a* is a hole extending substantially parallel to the z-axis and penetrating the cylindrical member 11, and is open at both the upper side and the lower side of the cylindrical member 11. A kitchen knife is inserted into the long hole 11*a* in a state where the extending direction of the blade is substantially parallel to the z-axis. Note that the long hole 11*a* may be a non-through-hole where only one of the upper side and the lower side is open. The long hole 11*a* of the first edged tool storage device 1 is one concrete example of the "first hole" in the invention. The long hole 11*a* of the second edged tool storage device 2 is one concrete example of the "second hole" in the invention.

<First Flange Group 12 and Second Flange Group 22>

The first flange group 12 includes flange members 13*a*, 13*b*, 13*c*, and 13*d*. The second flange group 22 includes flange members 23*a*, 23*b*, 23*c*, and 23*d*. In the following, each of the flange members 13*a*, 13*b*, 13*c*, and 13*d* may be referred to as a flange member 13. Each of the flange members 23*a*, 23*b*, 23*c*, and 23*d* may be referred to as a flange member 23.

The flange members 13 and 23 project from the cylindrical member 11 in a direction crossing the extending direction of the long hole 11*a* of the cylindrical member 11. In the embodiment, the flange members 13 and 23 are plate-form members projecting in a direction substantially orthogonal to the z-axis. In other words, the flange members 13 and 23 are plate-form members extending along the xy plane surface parallel to the bottom surface 11*c*.

The flange member 13 is made of a wooden material, for example. Note that the flange member 13 may be made of another kind of material such as resin or metal. The flange member 13 has a substantially isosceles trapezoidal shape with two bottom sides parallel to the y-axis, in a planar view from the z-axis (+)-side (see FIG. 5). To be more specific, in the planar view from the z-axis (+)-side, the flange member 13 includes a first side 16*a* positioned on the y-axis (+)-side of the long hole 11*a*, a second side 16*b* facing the first side 16*a* with the long hole 11*a* interposed therebetween, a third side 16*c* positioned between the first side 16*a* and the second side 16*b* on the x-axis (−)-side of the long hole 11*a*, and a fourth side 16*d* facing the third side 16*c* with the long hole 11*a* interposed therebetween. In the embodiment, a distance between the first side 16*a* and the second side 16*b* becomes larger toward the third side 16*c*. That is, in the flange member 13, the length of the fourth side 16*d* that is a bottom surface on the x-axis (+)-side is smaller than the length of the third side 16*c* that is a bottom surface on the x-axis (−)-side. In other words, in the flange member 13, the length of the third side 16*c* that is a bottom surface on the x-axis (−)-side is larger than the length of the fourth side 16*d* that is a bottom surface on the x-axis (+)-side. Thus, in a case where the first edged tool storage device 1 is placed on a table so that the third side 16*c* of the flange member 13 is on the lower side, the third side 16*c* of the flange member 13*a* and an end on the x-axis (−)-side of the upper surface 11*b* of the cylindrical member 11 are in contact with the table. In this manner, with the structure in which the long bottom side of the flange member 13*a* is in contact with the table when the first edged tool storage device 1 is laid laterally and placed on the table, the bottom side functions as a stably holding part and prevents falling of the first edged tool storage device 1. This allows the first edged tool storage device 1 to be placed stably on the table.

The flange members 13*a*, 13*b*, 13*c*, 13*d* are positioned in this order from the upper side to the lower side. Here, between the flange member 13*a* and the flange member 13*b*, there is formed a gap allowing arrangement of the flange member 23*a*. Between the flange member 13*b* and the flange member 13*c*, there is formed a gap allowing arrangement of the flange member 23*b*. Between the flange member 13*c* and the flange member 13*d*, there is formed a gap allowing arrangement of the flange member 23*c*.

In the embodiment, the flange members 13*a*, 13*b*, 13*c*, and 13*d* are arranged in a state where the cylindrical member 11 penetrates them. That is, the flange members 13*a*, 13*b*, 13*c*, and 13*d* project from the entire periphery of the cylindrical member 11. Moreover, the flange members 13*a*, 13*b*, 13*c*, and 13*d* are arranged so that the outer shapes of the flange members 13 overlap mutually in a planar view from the z-axis (+)-side (see FIG. 5).

The flange member 23 is made of the same material as the flange member 13. Note that the flange member 23 may be made of a material different from the material of the flange member 13. The flange member 23 has the substantially same shape and the substantially same thickness as the flange member 13. To be more specific, in the planar view from the z-axis (+)-side, the flange member 23 includes a first side 26*a* positioned on the y-axis (−)-side of the long hole 11*a*, a second side 26*b* facing the first side 26*a* with the long hole 11*a* interposed therebetween, a third side 26*c* positioned between the first side 26*a* and the second side 26*b* on the x-axis (+)-side of the long hole 11*a*, and a fourth side 26*d* facing the third side 26*c* with the long hole 11*a* interposed therebetween (see FIG. 3 and FIG. 5). In the embodiment, a distance between the first side 26*a* and the second side 26*b* becomes larger toward the third side 26*c*. That is, in the flange member 23, in a planar view from the z-axis (+)-side, the length of the fourth side 26*d* that is a bottom side on the x-axis (−)-side is smaller than the length of the third side 26*c* that is a bottom surface on the x-axis (+)-side (see FIG. 3 and FIG. 5). In other words, in the flange member 23, the length of the third side 26*c* that is a bottom side on the x-axis (+)-side is larger than the length of the fourth side 26*d* that is a bottom side on the x-axis (−)-side. In this manner, in a case where the first edged tool storage device 1 is placed on the table so that the third side 26*c* of the flange member 23 is on the lower side, it is possible to prevent falling of the first edged tool storage device 1, similarly to the case where the third side 16*c* of the flange member 13 is on the lower side. This allows the first edged tool storage device 1 to be placed stably on the table.

Moreover, the third side 26*c* of the flange member 23 and the third side 16*c* of the flange member 13 are positioned to face each other with the long hole 11*a* interposed therebetween. Thus, in a case where the first edged tool storage device 1 is placed on the table so that any of the third sides 16*c* and 26*c* is on the lower side, it is possible to stably place the first edged tool storage device 1 on the table.

The flange members 23*a*, 23*b*, 23*c*, and 23*d* are positioned in this order from the upper side to the lower side. The flange member 23*a* is arranged between the flange member 13*a* and the flange member 13*b*. The flange member 23*b* is arranged between the flange member 13*b* and the flange member 13*c*. The flange member 23*c* is arranged between the flange member 13*c* and the flange member 13*d*. The flange member 23*d* is arranged with a gap, from the flange member 23*c*, allowing arrangement of the flange member 13*d*.

In the embodiment, the flange members 23*a*, 23*b*, 23*c*, and 23*d* are arranged in a state where the cylindrical member 11 penetrates them. That is, the flange members 23*a*, 23*b*, 23*c*, and 23*d* project from the entire periphery of the cylindrical member 11. Moreover, the flange members 23*a*, 23*b*, 23*c*, and 23*d* are arranged so that the outer shapes of the flange members 23 overlap mutually in a planar view from the z-axis (+)-side (see FIG. 5).

In the embodiment, in a planar view from the z-axis (+)-side, the end surface on the x-axis (+)-side of the flange member 23 is positioned on the x-axis (+)-side of the end surface on the x-axis (+)-side of the flange member 13 (see FIG. 5). In other words, in a planar view from the z-axis (+)-side, the end surface on the x-axis (−)-side of the flange member 13 is positioned on the x-axis (−)-side of the end surface on the x-axis (−)-side of the flange member 23. In this manner, the flange member 13 is arranged to deviate from the flange member 23 in the x-axis direction, which forms a groove-shaped recess 15*a* between the flange member 13*a* and the flange member 13*b* on the x-axis (−)-side of the first edged tool storage device 1. Similarly, a groove-shaped recess 15*b* is formed between the flange member 13*b* and the flange member 13*c*. A groove-shaped recess 15*c* is formed between the flange member 13*c* and the flange member 13*d*. In other words, on the x-axis (−)-side of the first edged tool storage device 1, the flange members 13*a*, 13*b*, 13*c*, and 13*d* form flange-shaped projections 14*a*, 14*b*, 14*c*, and 14*d*, respectively. In the embodiment, the projections 14*a*, 14*b*, 14*c*, and 14*d* project over from the y-axis (+)-side to the x-axis (−)-side and then to the y-axis (−)-side outside of the cylindrical member 11 on the x-axis (−)-side of the first edged tool storage device 1. Moreover, the recesses 15*a*, 15*b*, and 15*c* are formed over from the y-axis (+)-side to the x-axis (−)-side and then to the y-axis (−)-side outside of the cylindrical member 11 on the x-axis (−)-side of the first edged tool storage device 1. In the following, each of the projections 14*a*, 14*b*, 14*c*, and 14*d* may be referred to as a projection 14. Each of the recesses 15*a*, 15*b*, and 15*c* may be referred to as a recess 15. The recess 15*a* is one concrete example of the "second recess" in the invention. The projections 14*a* and 14*b* are concrete examples of the "fourth projection" and the "first projection", respectively, in the invention.

Moreover, on the x-axis (+)-side of the first edged tool storage device 1, a groove-shaped recess 25*a* is formed between the flange member 23*a* and the flange member 23*b*. Similarly, a groove-shaped recess 25*b* is formed between the flange member 23*b* and the flange member 23*c*. A groove-shaped recess 25*c* is formed between the flange member 23*c* and the flange member 23*d*. In other words, on the x-axis (+)-side of the first edged tool storage device 1, the flange members 23*a*, 23*b*, 23*c*, and 23*d* form flange-shaped projections 24*a*, 24*b*, 24*c*, and 24*d*, respectively. In the embodiment, the projections 24*a*, 24*b*, 24*c*, and 24*d* project over from the y-axis (−)-side to the x-axis (+)-side and then to the y-axis (+)-side outside of the cylindrical member 11 on the x-axis (+)-side of the first edged tool storage device 1. Moreover, the recesses 25*a*, 25*b*, and 25*c* are formed over from the y-axis (−)-side to the x-axis (+)-side and then to the y-axis (+)-side outside of the cylindrical member 11 on the x-axis (+)-side of the first edged tool storage device 1. In the following, each of the projections 24*a*, 24*b*, 24*c*, and 24*d* may be referred to as a projection 24. Each of the recesses 25*a*, 25*b*, and 25*c* may be referred to as a recess 25. The recess 25*a* is one concrete example of the "first recess" in the invention. The projections 24*a* and 24*b* are concrete examples of the "second projection" and the "third projection", respectively, in the invention.

As illustrated in FIG. 1, the recesses 15*a*, 15*b*, and 15*c* of the first edged tool storage device 1 have a shape allowing fitting respectively with the projections 24*a*, 24*b*, and 24*c* of the second edged tool storage device 2 (see FIG. 1). The recesses 25*a*, 25*b*, and 25*c* of the second edged tool storage device 2 have a shape allowing fitting respectively with the projections 14*b*, 14*c*, and 14*d* of the first edged tool storage device 1 (see FIG. 1). Here, "allowing fitting" indicates that the recess and the projection are fitted into each other at a given fitting tolerance. In the embodiment, the projection and the recess are fitted into each other at a fitting tolerance allowing coupling and separation between the first edged tool storage device 1 and the second edged tool storage device 2 by manpower.

In the first edged tool storage device 1 and the second edged tool storage device 2, a distance between the bottom surface 11*c* of the cylindrical member 11 and the projection 14*b* is substantially same as a distance between the bottom surface 11*c* and the recess 25*a*. Similarly, a distance between the bottom surface 11*c* and the projection 14*c* is substantially same as a distance between the bottom surface 11*c* and the recess 25*b*. A distance between the bottom surface 11*c* and the projection 14*d* is substantially same as a distance between the bottom surface 11*c* and the recess 25*c*.

In the first edged tool storage device 1 and the second edged tool storage device 2, a distance between the bottom surface 11*c* of the cylindrical member 11 and the projection 24*a* is substantially same as a distance between the bottom surface 11*c* and the recess 15*a*. Similarly, a distance between the bottom surface 11*c* and the projection 24*b* is substantially same as a distance between the bottom surface 11*c* and the recess 15*b*. A distance between the bottom surface 11*c* and the projection 24*c* is substantially same as a distance between the bottom surface 11*c* and the recess 15*c*.

In a case where the first edged tool storage device 1 and the second edged tool storage device 2 are placed so that the bottom surface 11*c* of the first edged tool storage device 1 and the bottom surface 11*c* of the second edged tool storage device 2 are in contact with a substantially horizontal table, the projections 14 and 24 project substantially horizontally, and the recess 15 and the recess 25 are formed substantially horizontally. In this manner, in a case where the first edged tool storage device 1 and the second edged tool storage device 2 are coupled, the bottom surface 11*c* of the first edged tool storage device 1 and the bottom surface 11*c* of the second edged tool storage device 2 are in close contact with the table, which enables the edged tool storage device set 5 to be stably arranged in a self-standing state (see FIG. 1).

Moreover, in the embodiment, on the x-axis (−)-side of the first edged tool storage device 1, the projection 14 and the recess 15 are formed to surround the cylindrical member 11, while on the x-axis (+)-side of the second edged tool storage device 2, the projection 24 and the recess 25 are formed to surround the cylindrical member 11. Thus, with the arrangement where the projection 14 of the first edged tool storage device 1 is fitted into the recess 25 of the second edged tool storage device 2, it is possible to freely change an angle with which the first edged tool storage device 1 and the second edged tool storage device 2 are coupled.

Figure 6:
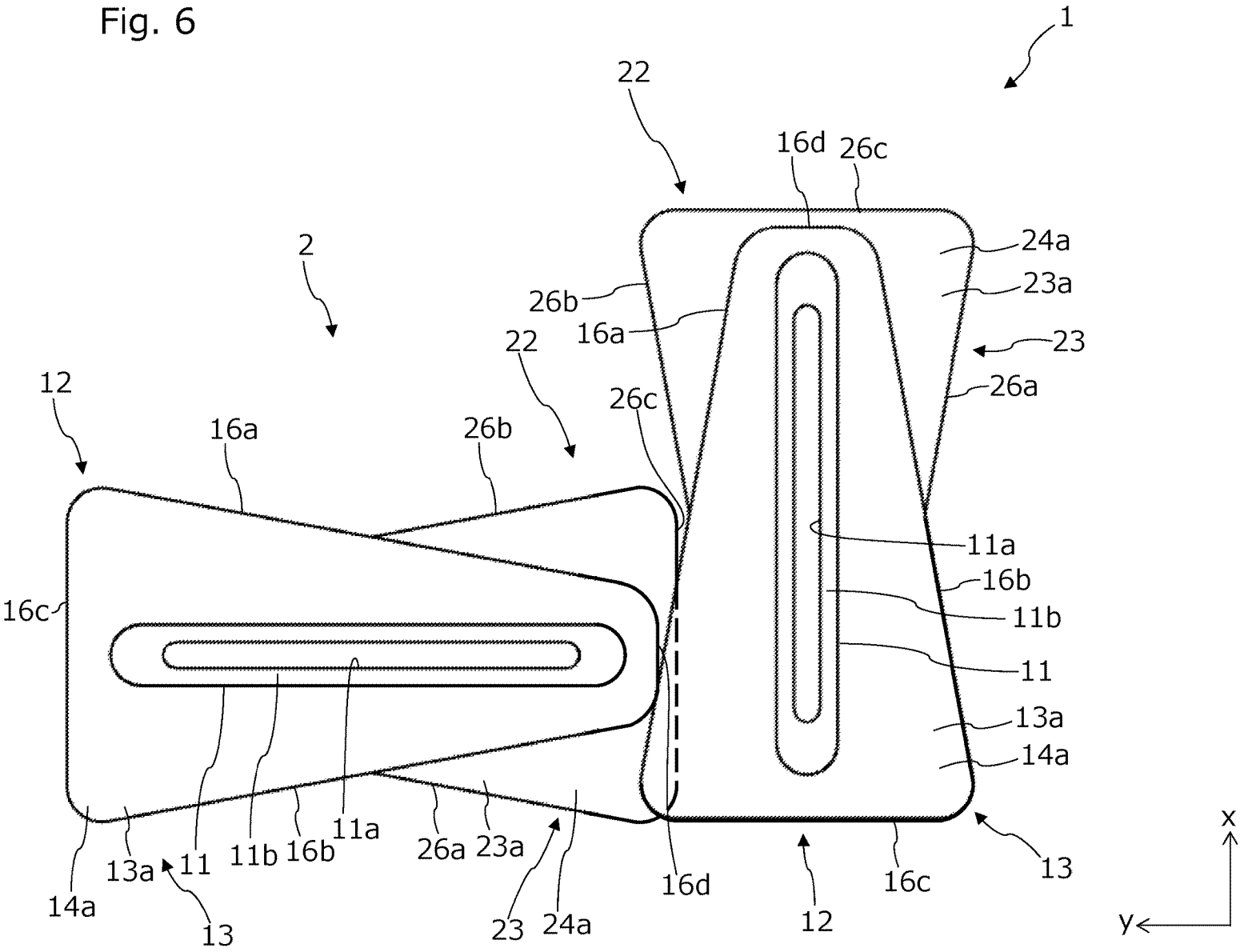
FIG. 6 is a plan view of two edged tool storage device of the embodiment coupled substantially orthogonally, viewed from the z-side (+)-side.

FIG. 6 is a plan view of two edged tool storage device of the embodiment coupled substantially orthogonally, viewed from the z-side (+)-side. FIG. 6 illustrates a structure in which the first edged tool storage device 1 and the second edged tool storage device 2 are coupled so that an angle formed by a long axis of the long hole 11*a* of the first edged tool storage device 1 (hereinafter, may be referred to as a first long axis) and a long axis of the long hole 11*a* of the second edged tool storage device 2 (hereinafter, may be referred to as a second long axis) is substantially 90°. To be more specific, the projection 24 of the second edged tool storage device 2 is fitted into the recess 15 facing the y-axis (+)-side of the first edged tool storage device 1. In this manner, it is possible to couple two edged tool storage device with a coupling angle changed freely, which allows the two edged tool storage device to be placed on the table with an angle which is excellent in appearance.

Figure 7:
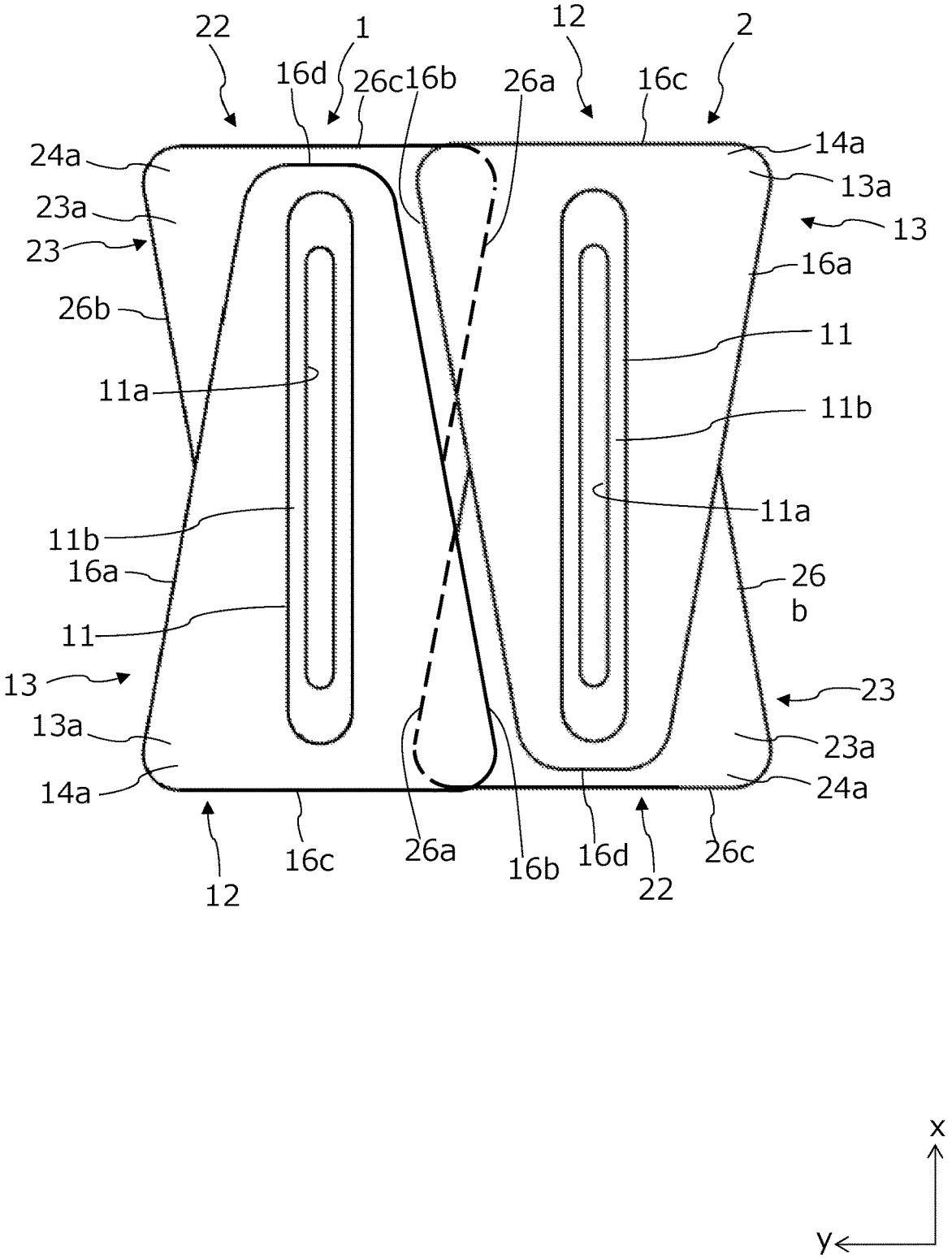
FIG. 7 is a plan view of two edged tool storage device of the embodiment coupled so that the long axes of long holes of cylindrical members are parallel, viewed from the z-axis (+)-side.

FIG. 7 is a plan view of two edged tool storage device of the embodiment coupled so that the first long axis and the second long axis are parallel, viewed from the z-axis (+)-side. FIG. 7 illustrates an example in which the second edged tool storage device 2 is positioned on the y-axis (−)-side of the first edged tool storage device 1. In this case, the projection 14 and the recess 15 of the first edged tool storage device 1 respectively fit the recess 25 and the projection 24 of the second edged tool storage device 2, and the projection 24 and the recess 25 of the first edged tool storage device 1 respectively fit the recess 15 and the projection 14 of the second edged tool storage device 2. Note that it is also possible to couple the second edged tool storage device 2 to the y-axis (+)-side of the first edged tool storage device 1. In this manner, it is also possible to couple two edged tool storage device so that the first long axis and the second long axis are parallel, which allows the two edged tool storage device to be placed on the table with an angle which is excellent in appearance.

2. Characteristics of Present Invention

The invention described above using the exemplified embodiment has the following characteristics.

In the above-described edged tool storage device set 5, it is possible to mechanically couple or separate the first edged tool storage device 1 and the second edged tool storage device 2, which enables adjustment of the number of storable edged tools by combining a plurality of edged tool storage device in accordance with a user preference and a use state. Furthermore, it is possible to build the edged tool storage device set 5 storing the first kitchen knife 3 and the second kitchen knife 4 with feeling of playfulness, such as when combining toy blocks. Moreover, it is possible to arrange the first edged tool storage device 1 and the second edged tool storage device 2 by coupling them to each other. This may give a collectively organized impression of the first edged tool storage device 1 and the second edged tool storage device 2 to a user, as compared with the case in which a plurality of edged tool storage devices are arranged independently. Consequently, it is possible to provide a edged tool storage device set 5 which is excellent in appearance. Therefore, it is possible to combine the edged tool storage devices in accordance with a user preference and a use state, and transform the first edged tool storage device 1 and the second edged tool storage device 2 from a kitchen knife holder simply having a function of storing a kitchen knife into an interior accessory with a sense of playfulness capable of storing edged tool. Moreover, with fitting between flanges and grooves, it is possible to freely change a coupling angle between the first edged tool storage device 1 and the second edged tool storage device 2. In this manner, it is possible to adjust the above-described coupling angle to an angle in accordance with a user preference, which improves the appearance of the edged tool storage device set 5.

Moreover, in the above-described edged tool storage device set 5, the projection 14 projects over from the y-axis (+)-side to the x-axis (−)-side and then to the y-axis (−)-side outside of the cylindrical member 11 of the first edged tool storage device 1. Thus, it is possible to expand a projecting direction of the projection 14 fitted into the recess 25 in the second edged tool storage device 2 from the y-axis (+)-side to the x-axis (−)-side and then to the y-axis (−)-side, and to expand a variable range of the coupling angle between the first edged tool storage device 1 and the second edged tool storage device 2.

Moreover, in the above-described edged tool storage device set 5, the recess 25 is formed over from the y-axis (+)-side to the x-axis (+)-side and then to the y-axis (−)-side outside of the cylindrical member 11 of the second edged tool storage device 2. Thus, it is possible to expand a formation direction of the recess 25 from the y-axis (+)-side to the x-axis (+)-side and then to the y-axis (−)-side, and to expand a variable range of the coupling angle between the first edged tool storage device 1 and the second edged tool storage device 2.

Moreover, in the above-described edged tool storage device set 5, in a planar view from the extending direction of the long hole 11*a* of the first edged tool storage device 1, the flange member 13 includes the first side 16*a*, the second side 16*b* facing the first side 16*a* with the long hole 11*a* of the first edged tool storage device 1 interposed therebetween, and the third side 16*c* positioned between the first side 16*a* and the second side 16*b*, and a distance between the first side 16*a* and the second side 16*b* becomes larger toward the third side 16*c*. In this manner, when the first edged tool storage device 1 is placed sideways on a table or the like, the long third side 16*c* is brought into contact with the table. Thus, it is possible to stably place the first edged tool storage device 1 sideways on the table without coupling with the second edged tool storage device 2. Moreover, even in a state where the first edged tool storage device 1 is coupled to the second edged tool storage device 2, it is possible to bring the long third side 16*c* into contact with the table and stably place the edged tool storage device set 5 sideways on the table.

Moreover, in the above-described edged tool storage device set 5, the projections 14 and 24 project substantially horizontally, and the recesses 15 and 25 are formed substantially horizontally. Thus, with fitting between the horizontally projected flanges and the horizontally formed grooves, it is possible to freely change a coupling angle between the first edged tool storage device 1 and the second edged tool storage device 2 in a self-standing state on a table, for example. This enables, for example, the first edged tool storage device 1 and the second edged tool storage device 2 to be stably placed on the table with a coupling angle which is excellent in appearance.

Moreover, in the above-described edged tool storage device set 5, the projection 24*a* projects in a flange form in a direction crossing the extending direction of the long hole 11*a* of the second edged tool storage device 2 from the cylindrical member 11 of the second edged tool storage device 2, and the projection 24*b* projects in a flange form substantially parallel to the projection 24*a* in the substantially same direction as the projecting direction of the projection 24*a*, so that the recess 25*a* is formed between the projection 24*a* and the projection 24*b*. This allows not only the recess 25*a* but also the projections 24*a* and 24*b* to be used for fitting with the recess 15*a* and the recess 15*b*, respectively, of the first edged tool storage device 1, which strengthens coupling with the first edged tool storage device 1. Moreover, the projections 24*a* and 24*b* arranged substantially parallel form a pleated appearance, which improves the appearance of the edged tool storage device set 5.

Moreover, in the above-described edged tool storage device set 5, the projection 14*b* has a flange form, and the projection 14*a* projects in a flange form substantially parallel to the projection 14*b* in the substantially same direction as the projecting direction of the projection 14*b*, so that the recess 15*a* is formed in a groove form between the projection 14*b* and the projection 14*a*. This allows not only the projection 14*b* but also the recess 15*a* to be used for fitting with the projection 24*a* of the second edged tool storage device 2, which strengthens coupling with the second edged tool storage device 2. Moreover, the projections 14*a* and 14*b* arranged substantially parallel form a pleated appearance, which improves the appearance of the edged tool storage device set 5.

Furthermore, in the above-described edged tool storage device set 5, a distance between the bottom surface 11*c* of the cylindrical member 11 and the projection 14*b* in the first edged tool storage device 1 is substantially same as a distance between the bottom surface 11*c* of the cylindrical member 11 and the recess 25*a* in the second edged tool storage device 2. Thus, in a case where the first edged tool storage device 1 is coupled to the second edged tool storage device 2, it is possible to match the bottom surface 11*c* of the cylindrical member 11 of the first edged tool storage device 1 and the bottom surface 11*c* of the cylindrical member 11 of the second edged tool storage device 2, which allows the first edged tool storage device 1 and the second edged tool storage device 2 to be stably arranged in a self-standing state. Moreover, also in a case where the first edged tool storage device 1 and the second edged tool storage device 2 are arranged to be laid, for example, it is possible to arrange these edged tool storage device close to a wall in a compact manner. Moreover, the matching state of the bottom surfaces 11*c* may give a collectively organized impression to a user, which improves the appearance of the edged tool storage device set 5.

3. Supplements

The embodiments and the modifications of the invention have been explained concretely. The above-described explanation is only explanation as one configuration example and one operation example, and the scope of the invention is not limited to these embodiments and modifications, and is to be interpreted widely within the range that is possible to be grasped by a person skilled in the art based on the same technical idea.

In the edged tool storage device set 5 of the embodiment, the kitchen knife is one concrete example of the "edged tool". However, kitchen scissors or a knife for medical use may be a concrete example of the "edged tool".

Moreover, in the first edged tool storage device 1 of the embodiment, a blade stopper for fixing a kitchen knife may be arranged in the long hole 11*a* of the cylindrical member 11. To be more specific, the blade stopper is made of an elastic member, for example, and elastically sandwiches and fixes a blade of the kitchen knife. Note that the blade stopper may be arranged in the second edged tool storage device 2.

Moreover, in the first edged tool storage device 1 of the embodiment, a finger rest may be attached to the cylindrical member 11. To be more specific, the finger rest has a shape allowing easy gripping with fingers, and facilitates movement of the first edged tool storage device 1 by a user gripping the finger rest. Moreover, a user grips the finger rest with one hand while holding the handle of the kitchen knife with the other hand, which allows the user to easily take out the kitchen knife from the first edged tool storage device 1. Note that the finger rest may be attached to the second edged tool storage device 2.

Moreover, in the edged tool storage device set 5 of the embodiments, the first edged tool storage device 1 and the second edged tool storage device 2 are arranged in a self-standing state on the table. However, the first edged tool storage device 1 and the second edged tool storage device 2 may be laid on the table. In this case, it is also possible that the first edged tool storage device 1 and the second edged tool storage device 2 are laid individually on the table without coupling the first edged tool storage device 1 and the second edged tool storage device 2.

Moreover, in the edged tool storage device set 5 of the embodiment, the first edged tool storage device 1 and the second edged tool storage device 2 are coupled. However, the third edged tool storage device may be further coupled to the first edged tool storage device 1 or the second edged tool storage device 2. That is, the edged tool storage device set 5 may have a structure not only with two edged tool storage device but also with three or more edged tool storage device.

INDUSTRIAL APPLICABILITY

The edged tool storage device set of the invention is preferably applied as a device storing edged tool, and the like.

REFERENCE SIGNS LIST

1 first edged tool storage device
2 second edged tool storage device
3 first kitchen knife
4 second kitchen knife
5 edged tool storage device set
11 cylindrical member
11*a* long hole
11*b* upper surface
11*c* bottom surface
12 first flange group
13*a*, 13*b*, 13*c*, 13*d* flange member
14*a*, 14*b*, 14*c*, 14*d* projection
15*a*, 15*b*, 15*c* recess
16*a* first side
16*b* second side
16*c* third side
16*d* fourth side
22 second flange group
23*a*, 23*b*, 23*c*, 23*d* flange member
24*a*, 24*b*, 24*c*, 24*d* projection
25*a*, 25*b*, 25*c* recess
26*a* first side
26*b* second side
26*c* third side
26*d* fourth side
100 kitchen utensil

What is claimed is:

1. An edged tool storage device set, comprising:
a first edged tool storage device; and
a second edged tool storage device, wherein
the first edged tool storage device includes a first case that has a first hole storing a blade of an edged tool and a flange-shaped first projection that projects from the first case in a direction crossing an extending direction of the first hole, and
the second edged tool storage device includes a second case that has a second hole storing a blade of an edged tool and a groove-shaped first recess that faces a direction crossing an extending direction of the second hole and has a shape allowing fitting with the first projection,
the first projection includes, in a planar view from the extending direction of the first hole, a first side, a second side facing the first side with the first hole interposed therebetween, and a third side positioned between the first side and the second side, and
a distance between the first side and the second side becomes larger toward the third side.

2. The edged tool storage device set according to claim 1, wherein the first projection extends along a first direction outside of the first case.

3. The edged tool storage device set according to claim 1, wherein the first recess extends along a second direction outside of the second case.

4. The edged tool storage device set according to claim 1, wherein the first projection projects substantially horizontally, and the first recess is formed substantially horizontally.

5. The edged tool storage device set according to claim 1, wherein
the second edged tool storage device further includes a flange-shaped second projection that projects from the second case in a direction crossing the extending direction of the second hole, and a flanged-shaped third projection that projects substantially parallel to the second projection in a substantially same direction as the projecting direction of the second projection, and
the first recess is formed between the second projection and the third projection.

6. The edged tool storage device set according to claim 5, wherein the first edged tool storage device further includes a flange-shaped fourth projection that projects substantially parallel to the first projection in a substantially same direction as the projecting direction of the first projection and a groove-shaped second recess that is formed between the first projection and the fourth projection.

7. The edged tool storage device set according to claim 1, wherein a distance between one end of the first case and the first projection is substantially same as a distance between one end of the second case and the first recess.

* * * * *